US007523792B2

(12) United States Patent
El-Rayes et al.

(10) Patent No.: US 7,523,792 B2
(45) Date of Patent: Apr. 28, 2009

(54) METHOD AND APPARATUS FOR SHIFTING SPEEDS IN A FLUID-ACTUATED MOTOR

(75) Inventors: Kosay I. El-Rayes, Dubai (AE); Peter J. Shwets, St. Albert (CA); Nazeeh Melhem, Edmonton (CA)

(73) Assignee: National Oilwell, Inc., Houston, TX (US)

( * ) Notice: Subject to any disclaimer, the term of this patent is extended or adjusted under 35 U.S.C. 154(b) by 202 days.

(21) Appl. No.: 11/292,892

(22) Filed: Dec. 2, 2005

(65) Prior Publication Data

US 2006/0243493 A1 Nov. 2, 2006

Related U.S. Application Data

(60) Provisional application No. 60/676,342, filed on Apr. 30, 2005.

(51) Int. Cl.
*E21B 4/02* (2006.01)

(52) U.S. Cl. ..... 175/92; 175/100; 175/107; 415/903; 137/253; 137/118.06; 137/119.08

(58) Field of Classification Search ..... 175/92, 175/100, 231, 232, 107; 415/903; 137/253, 137/118.06, 119.08, 119.04
See application file for complete search history.

(56) References Cited

U.S. PATENT DOCUMENTS 4,768,598 A * 9/1988 Reinhardt ..... 175/26
5,890,540 A * 4/1999 Pia et al. ..... 166/321
6,263,969 B1 7/2001 Sotesz et al.
6,289,998 B1 * 9/2001 Krueger et al. ..... 175/25
6,308,783 B2 10/2001 Pringle
6,520,271 B1 2/2003 Martini
6,854,953 B2 2/2005 Van Drentham-Susman et al.

OTHER PUBLICATIONS

International Search Report dated Sep. 21, 2007.

* cited by examiner

*Primary Examiner*—David J Bagnell
*Assistant Examiner*—Brad Harcourt
(74) *Attorney, Agent, or Firm*—Howrey LLP

(57) ABSTRACT

A method and apparatus for changing the speed of a drill bit down hole in a fluid-actuated motor, including a positive displacement motor and a hydraulic motor, is disclosed. The apparatus comprises a bypass valve installed in the motor for controlling flow through and around the power section of the motor. When closed, the bypass valve forces all fluid to flow through the power section of the motor, imparting maximum speed to the drill bit. When opened, a portion of the fluid flow is allowed to flow around the power section of the motor, thereby reducing the speed of the drill bit. The bypass valve may be opened or closed mechanically, electrically, hydraulically, pneumatically, or by any other means, including a removable plug.

48 Claims, 10 Drawing Sheets

METHOD AND APPARATUS FOR SHIFTING SPEEDS IN A FLUID-ACTUATED MOTOR

CROSS REFERENCE TO RELATED APPLICATION(S)

This application claims priority from U.S. Provisional Patent Application No. 60/676,342, filed Apr. 30, 2005, by inventors Kosay El-Rayes, Nazeeh Melhem, and Peter Shwets, entitled "Method for Shifting Speeds in a Fluid-Actuated Motor," which is hereby incorporated by reference.

FIELD OF THE INVENTION

The present invention generally relates to fluid-actuated motors, including positive displacement motors, known as Moineau pump-type drilling motors, and hydraulic motors, and specifically to a fluid-actuated motor having a variable rotor bypass valve installed therein to alter the rotational speed of the drill bit without the need for the motor to be removed from the well.

BACKGROUND OF THE INVENTION

In the oil drilling industry, there are two traditional methods of drilling an oil well. One is to attach a drill bit at the end of a drill string, apply downward pressure, and rotate the drill string from the surface so that the drill bit cuts into a formation. The problem with this method is that as the hole becomes deeper and the drill string becomes longer, the frictional forces due to the rotation of the drill string down hole increase, especially in deviated and horizontal wells.

The second method is to place a motor down hole near the drill bit. This method requires a special type of motor (or pump) called a positive displacement motor, or PDM. The PDM is also referred to in the oil drilling industry as a Moineau pump or mud motor. It has a long spiral rod inside of it, called a rotor, which spins inside of a stator as fluid is continually pumped down the drill string through the motor. The speed at which a mud motor rotates depends upon the internal geometry of the motor, the flow rate of the fluid that is pumped down the drill string to turn the motor, and the resistance of the formation against the drill bit. Although the pumping of the fluid down the drill string is one factor that determines the speed at which the drill bit rotates, the circulation of the drilling fluid serves other purposes as well. For example, it circulates the cuttings out of the hole and cools the drill bit as it cuts into harder formations.

When drilling a hole, an operator frequently encounters the need to change the rotational speed of the drill bit. When drilling through harder, more difficult formations, slower bit speeds are required. When encountering softer formations, an operator may select a faster drill speed to drill quickly through the formation. If an operator cannot change the flow rate of the fluid pumped down the drill string because, for example, the operator needs to maintain some minimum flow rate to circulate the cuttings out of the hole, then the only other option to change drill speeds is to change the internal geometry of the motor.

Prior art motors do not have the ability to change their internal geometries down hole without bypassing a portion of the fluid flow outside the drill string. This has at least two deleterious effects. First, not all of the fluid pumped down a drill string will pass through the drill bit to cool it, and, second, not all of the fluid flow pumped down the drill string will be used to circulate the cuttings out of the hole.

One way to overcome these problems is to remove the drill string from the hole and replace the motor with one having a different internal geometry or to modify the internal geometry of the motor used. The removal of the drill string to replace a motor is time consuming and expensive. Consequently, there is a need in the art for a method and/or apparatus that allows an operator to change the internal geometry of mud motors down hole without passing a portion of the fluid flow outside the drill string.

SUMMARY OF THE INVENTION

The present invention allows an operator to change the rotational speed of the drill bit by causing a portion of the fluid that is pumped through the drill string to bypass that part of the power section of a motor that imparts rotational motion on the drill bit without passing any of the fluid outside of the drill string. This is accomplished by means of a bypass valve installed inside, above, or below the power section of the motor.

The bypass valve separates the fluid flow through the power section into two paths. One path is directed through that part of the power section that causes the drill bit to rotate while the other path is directed around it. When the bypass valve acts to cause all of the fluid to flow through the power section of a motor, the drill bit will rotate at maximum speed. When the bypass valve acts to bypass a portion of the fluid through a port in the power section, the drill bit will rotate at a slower speed. The actual internal geometry of the fluid flow through the power section in conjunction with the fluid flow pressure maintained at the mud pump determines the actual speed of rotation. After the bypass valve separates the fluid into two flow paths, the flow is recombined inside the motor before it is channeled to the drill bit. This allows all of the fluid that flows down the drill string to cool the drill bit and to circulate the cuttings back up to the surface without any detrimental impact on system performance.

In underbalanced drilling, the fluid pumped down the drill string is composed of a mixture of fluid and gas. The fluid that is diverted around the power section when the bypass valve is open may then comprise the gas.

In one embodiment, the bypass valve is attached to the bottom portion of the rotor of a typical mud motor. As mentioned above, a rotor is a long spiral rod that spins inside of a stator. The fluid that is pumped down the drill string passes through and around the rotor. The portion of the fluid that passes around the rotor causes the rotor to spin. The portion of the fluid that passes through the center of the rotor has no effect on the rotor's rotational speed. By placing a bypass valve along the fluid path through the center of the rotor, the fluid that passes through the center of the rotor can be manipulated and controlled. In this embodiment, closing the bypass valve blocks the fluid from passing through the center of the rotor and forces all of the fluid flow around the rotor. This configuration imparts maximum rotational speed to the drill bit. Opening the bypass valve allows a portion of the fluid flow to pass through the center of the rotor. By altering the flow paths inside the motor, the rotational speed of the drill bit can be manipulated and set.

The bypass valve attaches inside of a motor and consists of a rotor adapter and a housing. The rotor adapter attaches to the end of the rotor and has an inner diameter, or cavity, that allows fluids to pass from the center of the rotor into the housing. A cam inside the housing is configured to rotate axially along the flow path each time the mud pump controlling the fluid flow down the drill string is cycled on and off. When the mud pump is turned on, fluid flow forces the cam into contact with one or more stationary splines on the inner diameter of the housing. As the cam continues to move forward, an outer axial surface on the cam contacts an angled surface on the spline and forces the cam to rotate axially along the flow path. Each time the cam is rotated, a different set of slots along the outer diameter of the cam slide in between splines on the housing. The length of each slot changes with each rotation. When the flow pump is initially turned on, the slot that initially slides along the splines is short, resulting in the cam traversing only a part of the path downwards towards the lower end of the housing. When the flow pump is turned off, a biasing spring at the bottom of the housing pushes the cam upwards to its original position. The next time the flow pump is turned on, the cam is rotated again and a longer slot is selected, allowing the cam to traverse the full length of the path inside the housing as it is pushed downwards by the fluid pressure against the biasing spring at the bottom of the housing. When the cam is allowed to traverse the full length of the housing, a radial exit hole in the cam aligns with a radial exit hole in the housing to provide a flow path from the center of the rotor to the inside diameter of the motor containing the bypass valve. This allows a portion of the fluid in the drill string to flow through the center of the rotor. When a shorter slot is selected, the radial holes in the cam do not align with the radial holes in the lower housing. Consequently, the flow of fluid through the center of the rotor is blocked and all fluid passes around the rotor, allowing the rotor to turn at its maximum designed speed.

Each time the cam is rotated, a longer or shorter slot is alternatively selected, and the bypass valve is alternatively opened or closed. In another embodiment, three different slot lengths may be used and alternatively selected, one slot fully closing the bypass valve, another slot partially opening the bypass valve, and the last slot fully opening the bypass valve. In such an embodiment, the operator may select one of three speeds for the motor.

In other embodiments, the bypass valve may be opened and closed by an electrical motor installed in the tool. A wireline running tool having electric cables is inserted: into the bore and connected to the electric motor. The wireline running tool applies electric power and signals to the motor to open and close the bypass valve.

The valve may also be configured to open and close mechanically. A wireline running tool is inserted into the bore and physically connected to a valve that opens by mechanical pull. An upward force applied to the wireline tool physically opens the valve. Alternatively, the valve may be configured to open when heavy force is applied to the top of the bypass valve. The force may be a heavy bar dropped on top of the valve while the valve is inside the drill string causing the valve to shift to an open or closed position.

The bypass valve may also be configured to open by hydraulic, pneumatic, or other means. Electrical, mechanical, hydraulic, and pneumatic means of opening and closing valves in a drill string are well known in the art.

In even another embodiment, the amount of fluid that flows through the bypass valve when open is controllably selected by the size of a replaceable nozzle that installs inside the cam. The replaceable nozzle is configured to restrict a certain amount of flow through the cam and the housing when the bypass valve is open, thereby allowing a drilling operator to pre-set the speed of the drill bit.

In still another embodiment, the bypass valve may also be configured to open and close automatically based upon the type of formation encountered during drilling. When the drill bit encounters a harder formation, more weight is needed to press through it. The increased weight increases the friction on the bit and the pressure experienced by the motor. The bypass valve can be configured to respond to the increased pressure by, for example, opening one or more spring-loaded outlet valves. When the increased pressure experienced by the motor overcomes the closing forces of the spring-loaded outlet valves, the outlet valves open, diverting a portion of the fluid flow around the power section of the rotor and slowing the speed of the drill bit. The spring-loaded outlet valves may be configured to adjust to the amount of pressure experienced by the motor, allowing the amount of fluid to flow around the power section of the motor to be a function of the pressure experienced by the motor.

In addition to the above embodiments, a removable plug may be dropped down the drill string to plug the bypass valve, preventing the bypass valve from diverting fluid around the power section of the motor or, alternatively, closing off all fluid flow through the motor. The removable plug may be pre-installed and removed by a wireline running tool by applying an upward force that shears the plug from its pre-installed position. Both the installation and removal of plugs from downhole tools are well known in the art and are applicable to a downhole tool having a bypass valve described herein.

A method of shifting speeds of a motor consistent with the description above is as follows: installing on a drill string a motor capable of changing rotational speeds of a drill bit; drilling into a first formation; opening a bypass valve to change the rotational speed of the drill bit; and continue drilling into the first formation or into a second formation. An alternate method consistent with automatic selection of drill speeds is as follows: installing on a drill string a motor capable of changing speeds; drilling into a formation; sensing a change in the formation resulting from increased or decreased frictional forces on the drill bit; and opening or closing a valve to change the rotational speed of the drill bit.

The invention described herein is not limited to mud motors or to applications for drilling through down hole formations, but applies to any motor that uses fluidic means for turning a drive shaft where control of the rotational speed of the motor is accomplished by manipulating the flow of fluid through the power section of the motor, such as a turbine motor.

DETAILED DESCRIPTION

Figure 1:
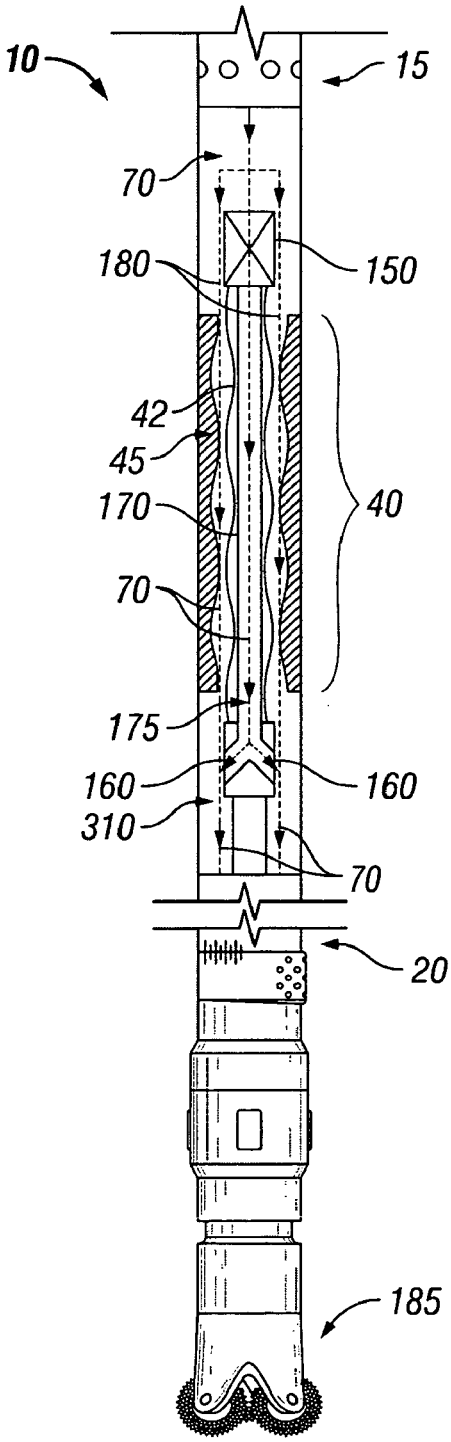
FIG. 1 is a view of an exemplary embodiment of a positive displacement motor having a bypass valve in the open position attached above the power section of the motor.

FIG. 1 is a diagram of an exemplary embodiment of a typical positive displacement motor 10 ("PDM"), or mud motor. The top side 15 of the motor connects to a drill string (not shown). The bottom side 20 connects to a drill bit 185. The power section 40 comprises a rotor 42 and stator 45. When a mud pump is turned on, fluid 70 enters the drill string, flows through the power section 40 and exits the bottom side 20 of the motor.

Figure 2:
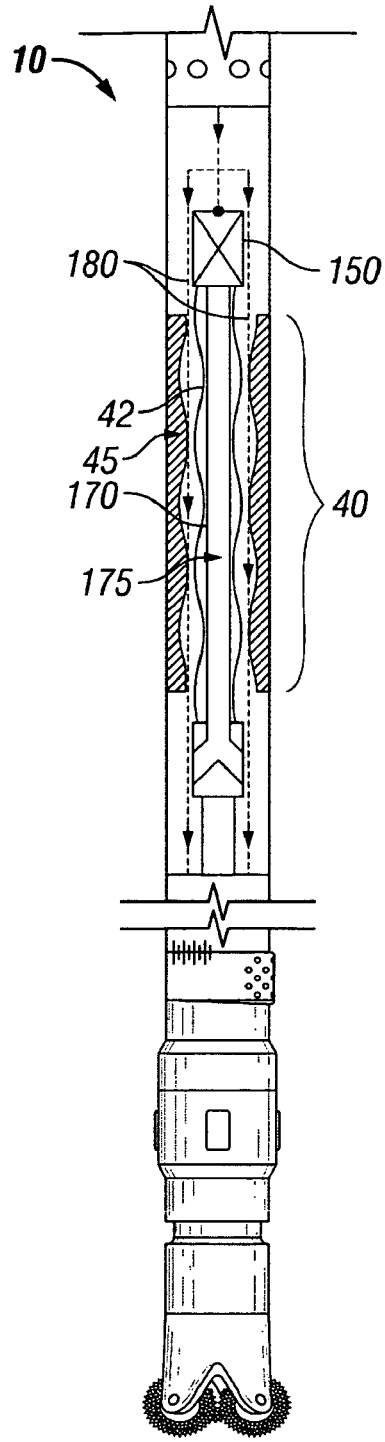
FIG. 2 is a view of an exemplary embodiment of a positive displacement motor having a bypass valve in the closed position attached above the power section of the motor.
Figure 3:
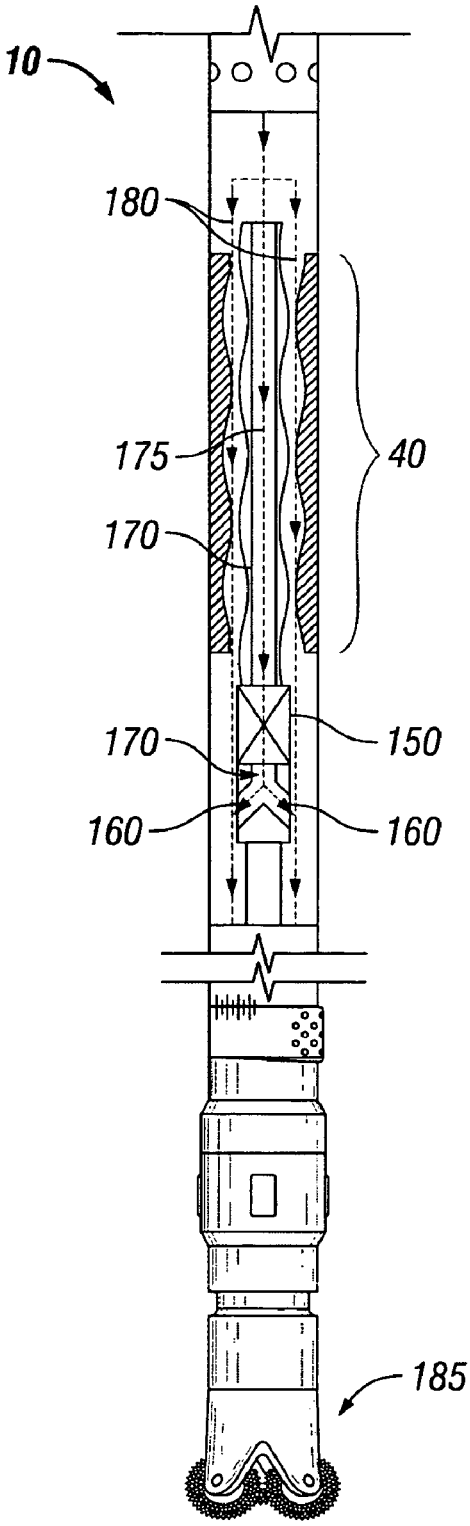
FIG. 3 is a view of an exemplary embodiment of a positive displacement motor having a bypass valve in the opened position attached below the power section of the motor.
Figure 4:
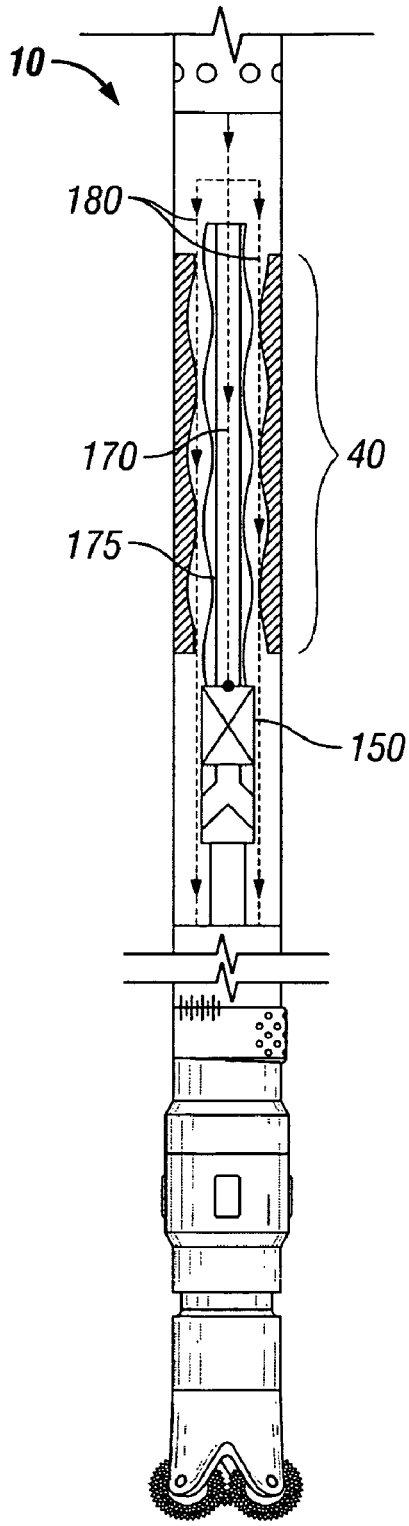
FIG. 4 is a view of an exemplary embodiment of a positive displacement motor having a bypass valve in the closed position attached below the power section of the motor.
Figure 5:
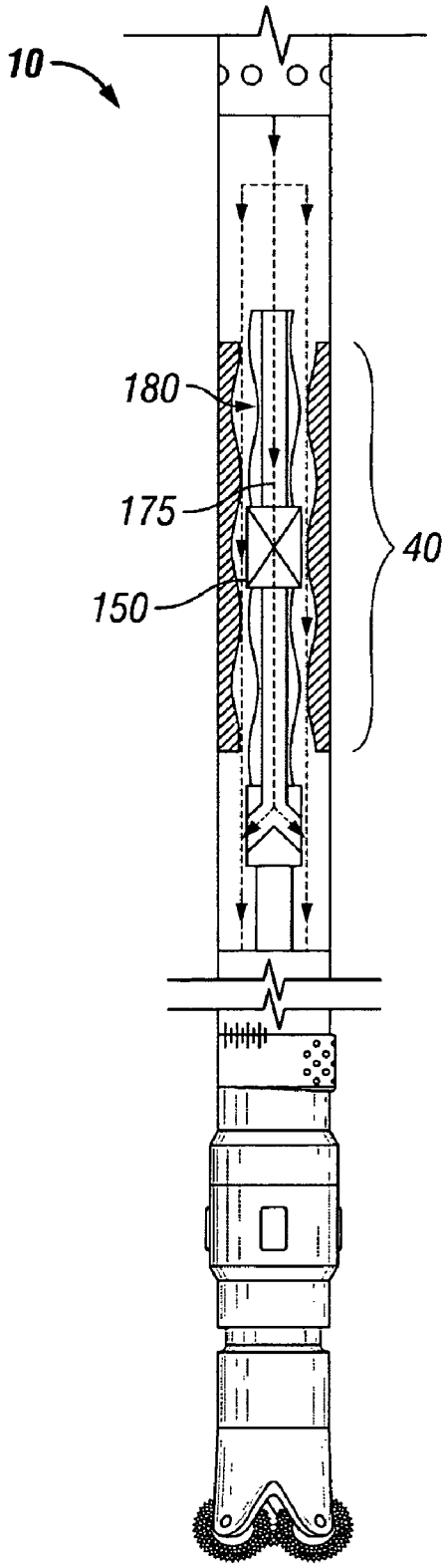
FIG. 5 is a view of an exemplary embodiment of a positive displacement motor having a bypass valve in the opened position attached inside the power section of the motor.
Figure 6:
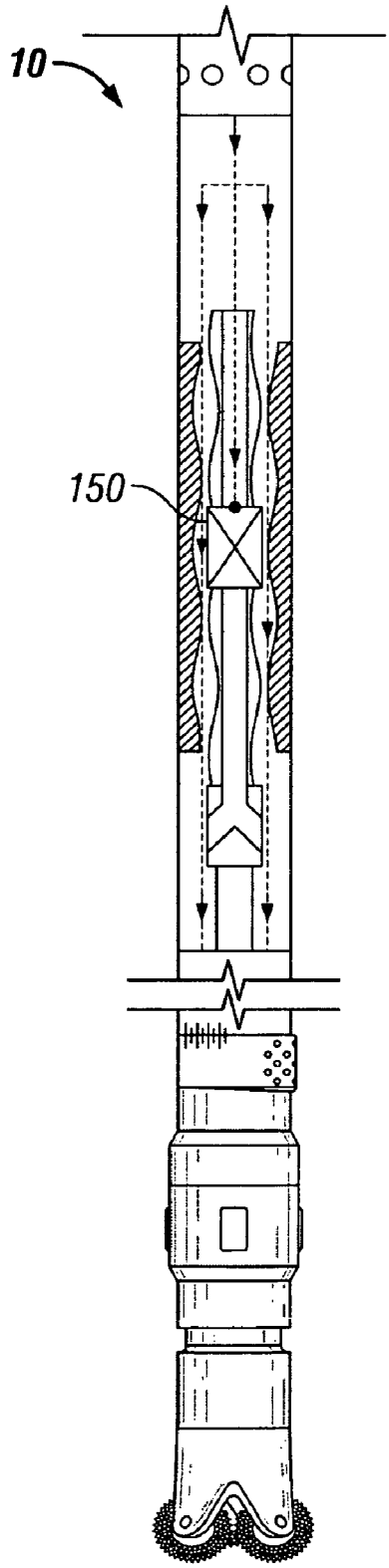
FIG. 6 is a view of an exemplary embodiment of a positive displacement motor having a bypass valve in the closed position attached inside the power section of the motor.

FIG. 2 is a diagram of an exemplary embodiment of a typical positive displacement motor 10 having a bypass valve 150 attached above the power section 40 of the motor 10; FIGS. 3 and 4 show the bypass valve 150 attached below the power section 40 of the motor 10; and FIGS. 5 and 6 show the bypass valve 150 attached inside the power section 40 of the motor. Because operation of the bypass valve is similar regardless of whether it attaches above, below, or inside the power section of a motor, only the operation of the bypass valve of FIGS. 1 and 2 need be explained.

Referring to FIG. 1, bypass valve 150 is installed inside motor 10 in fluid flow path 70 in the drill string. When bypass valve 150 is open, a portion of the fluid flow 175 in path 70 passes through bypass channel 170. In a typical mud motor having a rotor 42 and stator 45, the flow around the rotor 42 is shown by flow path 180 and the flow through the center of the rotor 42 is shown by bypass path 175. In other motors, such as turbines, bypass path 175 represents flow through a bypass port in the turbine power section and flow path 180 represents flow through the turbine blades or fins. Because only a portion of the fluid flow from the drill string flows around the rotor 42 when bypass valve 150 is open, the rotor 42 rotates at less than its maximum speed.

When bypass valve 150 is closed, as shown in FIG. 2, all fluid flow is forced to flow around the rotor 42. In this configuration, bypass flow 175 through the center of the rotor 170 is blocked. For other motors, such as a turbine, bypass flow 170 represents the flow through a bypass port in the turbine power section, and flow path 180 represents flow across the turbine blades or fins. Thus, when bypass valve 150 is closed, all flow is forced across the turbine blades or fins and the turbine rotates at its maximum speed.

When bypass valve 150 is open (FIG. 1), the fluid flow 70 through the drill string is separated into two flow paths, bypass path 175 and flow path 180. The two paths are recombined at 160 and sent to the drill bit 185. None of the flow through bypass path 175 is diverted outside the drill string. By recombining the two flow paths, all fluid flow pumped down the drill string from the surface is used to cool the drill bit and circulate cuttings out of the hole.

Figure 7:
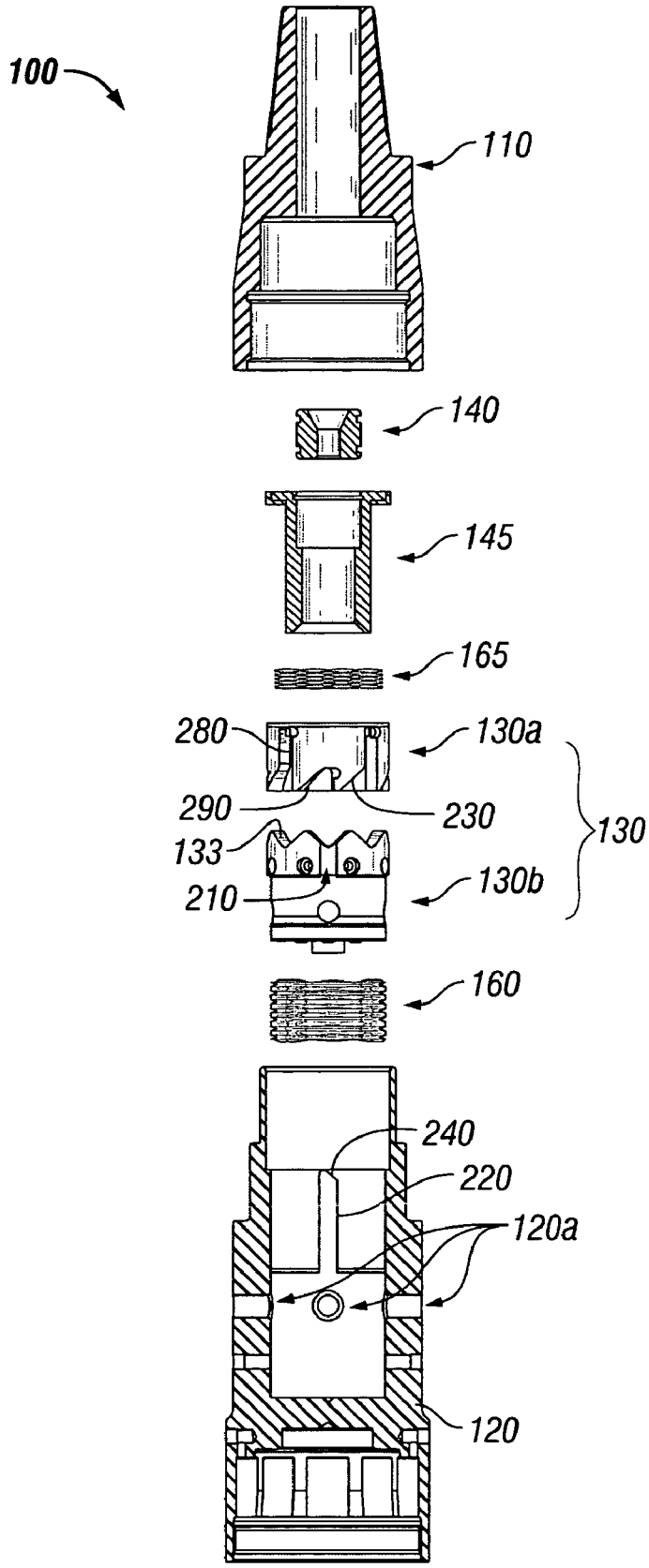
FIG. 7 is an exploded view of an exemplary embodiment of a bypass valve.

Referring to FIG. 7, a mud motor bypass valve 100 of the type consistent with the present invention includes a rotor adapter 110, a housing 120, a replaceable nozzle 140, a nozzle piston 145, a spring 160, and a cam 130. The rotor adapter 110 connects to the bottom of a mud motor rotor (not shown) on a drill string, though in other embodiments, it may connect to the top of the rotor. The bottom of the housing 120 attaches to the top of the motor drive shaft (not shown). The cam 130 includes an index ring 130*a* and a flow piston 130*b*, both with milled outer, axial surfaces 133 and 230 for axially rotating the index ring 130*a* relative to the flow piston 130*b*. The bypass valve 100 of FIG. 7 replaces the upper U-Joint of a drive shaft in a typical mud motor.

Figure 8:
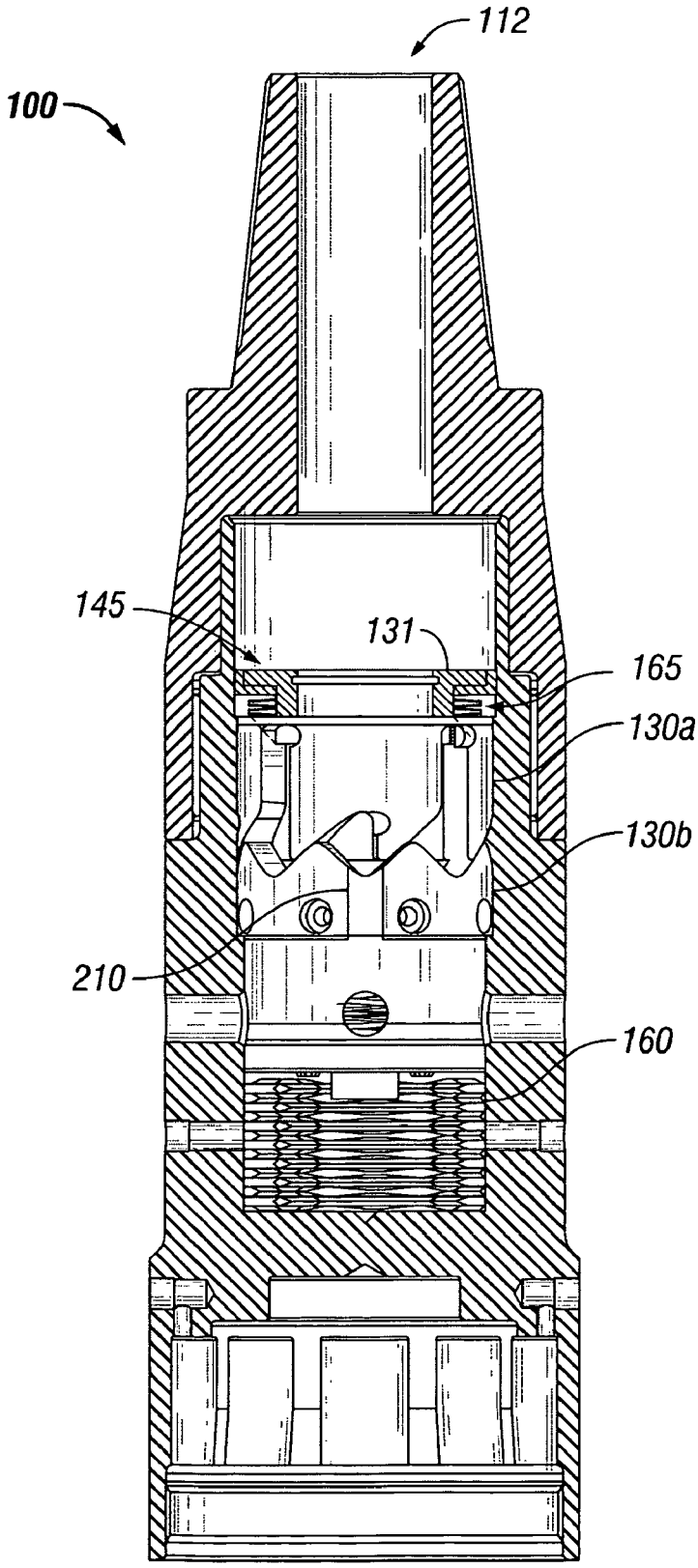
FIG. 8 is a view of the exemplary embodiment of the bypass valve of FIG. 7 with the components interconnected.

Referring to FIG. 8, when the mud pump is turned on at the surface, fluid is pumped down a drill string to entrance cavity 112. When the fluid enters the entrance cavity 112, pressure builds up along the top surface 131 of the nozzle piston 145 and forces the index ring downwards in tandem with the flow piston 130*b* and against the upward biasing force of a spring 160. The fluid flowing around the rotor does not pass through the bypass valve 100 until the radial exit holes 130*c* (FIG. 10) on flow piston 130*b* (FIG. 10) align with radial exit holes 120*a* (FIG. 10) on housing 120.

Figure 9:
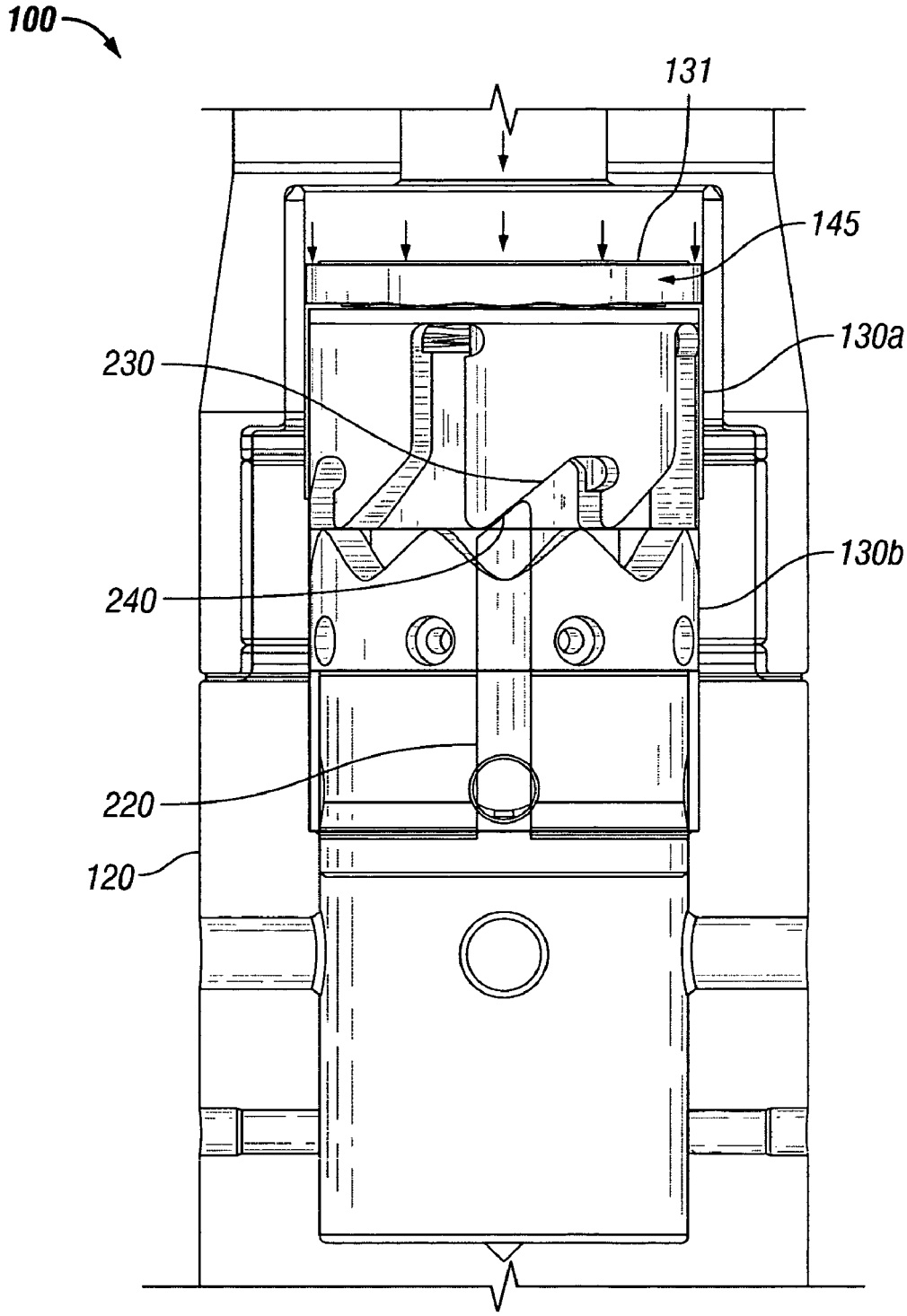
FIG. 9 illustrates the movement of the index ring relative to the housing and flow piston when fluid flow pressure is initially applied.
Figure 10:
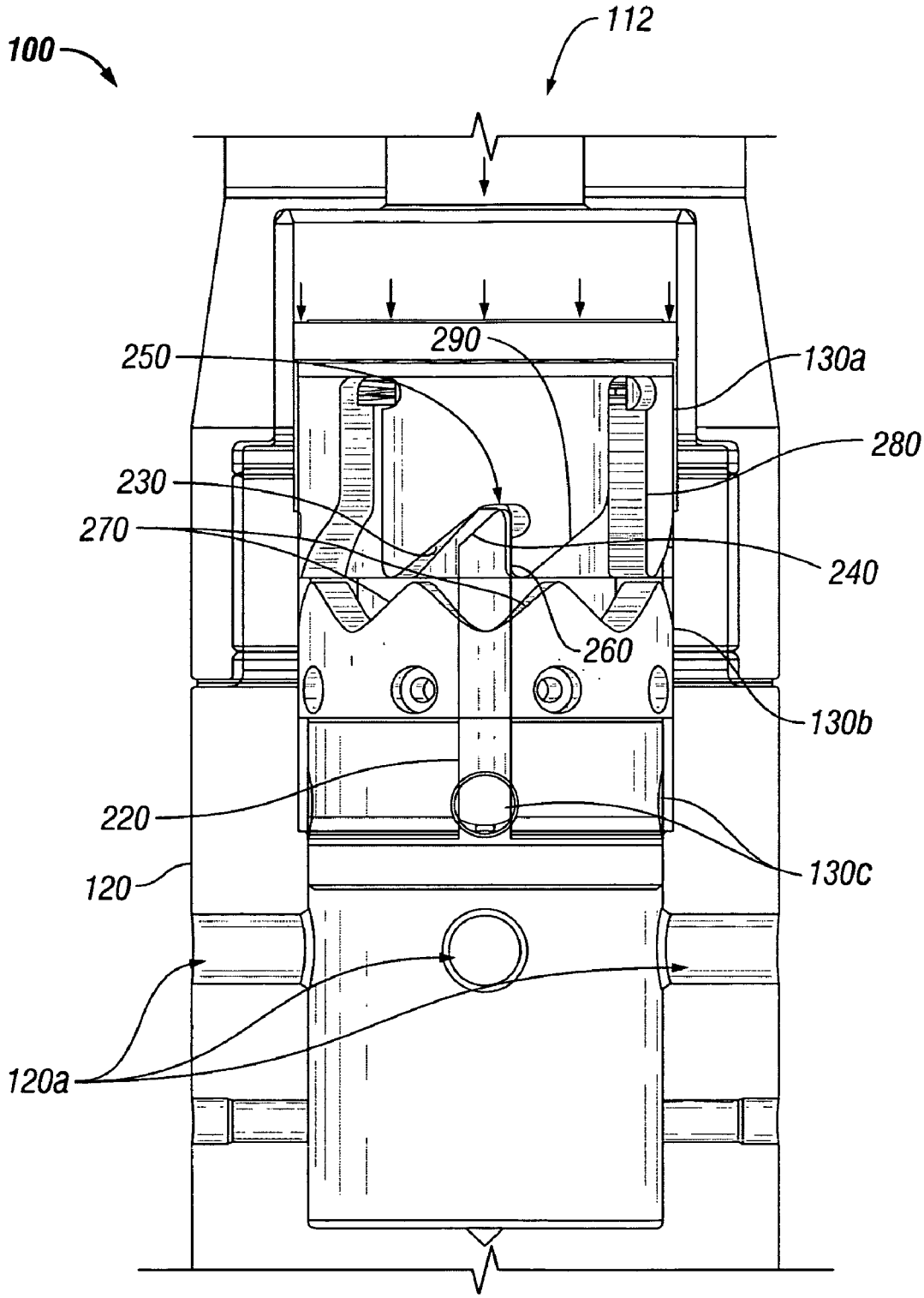
FIG. 10 illustrates the positioning of the index ring, flow piston, and housing relative to one another after the fluid flow pressure has been initially applied.

Referring to FIGS. 8 and 9, flow piston 130*b* has a slotted surface 210 (FIG. 8) for sliding along spline 220 (FIG. 9), which is part of housing 120. Spline 220 prevents flow piston 130*b* from rotating inside housing 120. As index ring 130*a* moves downward, milled surface 230 engages spline 220 on the housing at slanted surface 240. Slanted surface 240 corresponds to milled surface 230 for engaging the index ring 130*a* and causing the index ring 130*a* to rotate relative to flow piston 130*b*. Rotation continues with continued downward movement of the index ring 130*a* until spline 220 reaches slotted surface 250, as illustrated in FIG. 10. Referring now to FIG. 10, at this point, slotted surface 250 impedes any further downward movement of index ring 130*a*, and radial exit holes 130*c* on flow piston 130*b* remain above radial exit holes 120*a* on housing 120, preventing the fluid entering through entrance cavity 112 from escaping through the housing 120. Housing 120 is configured to block fluid flow through the bypass valve 100 unless the radial exit holes 130*c* on flow piston 130*b* aligns with radial exit holes 120*a* on housing 120. The index ring 130*a*, flow piston 130*b*, and housing 120 remain in their relative positions, as shown in FIG. 10, for as long as fluid pressure is applied to the drill string from the surface. In this configuration, bypass valve 100 effectively blocks all fluid passing through the center of the rotor resulting in the drill bit turning at its maximum speed.

When fluid pressure is released from the drill string, spring 160 (FIG. 8) forces flow piston 130*b* and index ring 130*a* upwards towards its initial position. Index ring 130*a*, however, remains partially rotated. As the spring pushes index ring 130*a* upwards, milled surface 260 (FIG. 10) passes above spline 220. Spline 220 no longer holds index ring 130*a* in place relative to flow piston 130*b*. Milled surfaces 230 and 290 cause index ring 130*a* to rotate relative to flow piston 130*b* by sliding along milled surfaces 270 on flow piston 130*b* due to the continually applied force of reset spring 165 (FIG. 8) pushing the index ring 130*a* (FIG. 10) downwards against flow piston 130*b* (FIG. 10), allowing slot 280 (FIG. 10) to position itself above spline 220 to cause additional rotation the next time fluid pressure is applied to the drill string.

Figure 11:
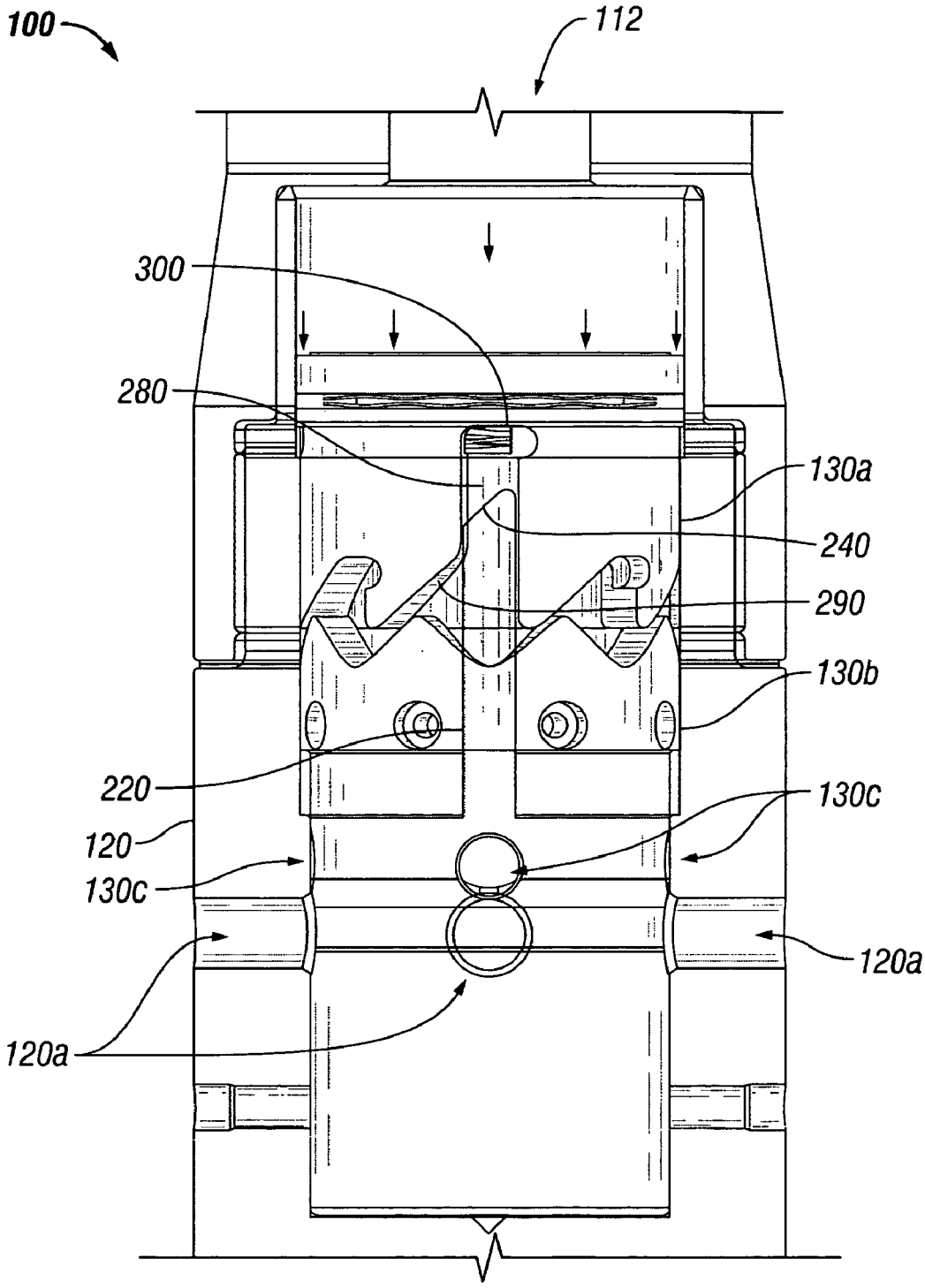
FIG. 11 illustrates the alignment of a slot milled on the outer radial surface of the index ring with a spline in the inner diameter of the housing when fluid flow pressure is applied a second time.

Referring now to FIG. 11, when pressure is reapplied to the drill string, index ring 130*a* is again forced downwards towards spline 220. This time, however, slanted surface 240 on spline 220 contacts the top of angled surface 290 next to slot 280, causing index ring 130*a* to rotate until slot 280 is aligned with spline 220, as shown in FIG. 11. Slot 280 is longer than slot 250 (FIG. 10) so that index ring 130*a* will continue to move downwards until spline 220 contacts surface 300. At this point, radial exit holes 130*c* on flow piston 130*b* will be aligned with radial exit holes 120*a* on the housing 120. This alignment opens a flow path between entrance cavity 112 and the annulus 310 (FIG. 1) between housing 120 and the motor 10 (FIG. 1). As fluid flows along this path, less fluid flows around the rotor, causing the speed of the rotor to decrease. The fluid flowing through and around the rotor are then recombined in the annulus and sent to the drive shaft and drill bit.

Figure 12:
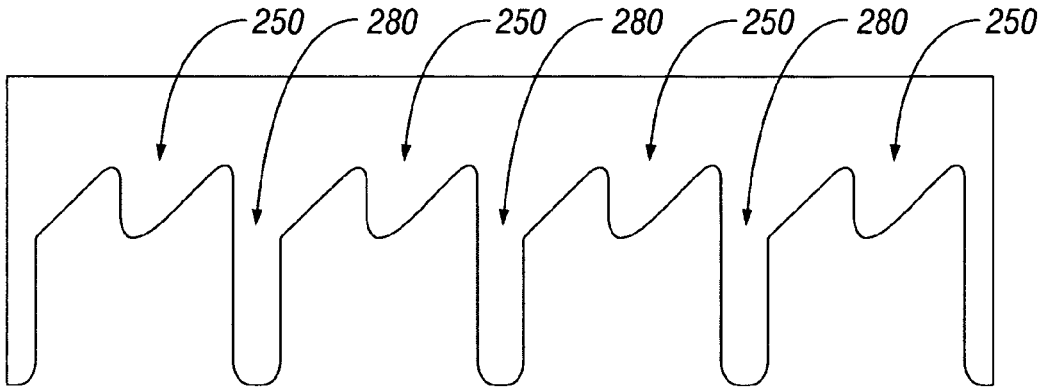
FIG. 12 is a two-dimensional layout of the slotted outer surface of the index ring consistent with the exemplary embodiment of FIGS. 7-11. The figure shows the pattern of alternating between a deep slot, item 280, and a shallow slot, item 250.

FIG. 12 is a two-dimensional rollout diagram of the milled outer surface of the index ring 130*a*. The figure shows that in one embodiment, slots 280 alternate with slots 250 along the surface. Referring now to FIGS. 10-12, the length of slots 280 are milled such that when the index ring 130*a* moves downwards towards the bottom of the housing 120, the radial exit holes 130*c* of the flow piston 130*b* will align with the radial exit holes 120*a* of housing 120. The length of slots 250 are milled such that when fluid pressure is applied to the drill string and index ring 130*a* is pushed downwards towards the bottom of the housing 120, spline 220 will hold the index ring and flow piston 130*b* in a position where the radial exit holes remain out of alignment. Because the index ring 130*a* rotates only one slot at a time each time power to the mud pump is cycled and because slots 250 and 280 are milled in alternating succession, the bypass valve will alternate between an open position and a closed position each time the mud pump is cycled. In this configuration, the mud pump rotates at two speeds, one speed corresponding to the open position and another speed corresponding to the closed position.

In other embodiments, the slots shown in FIG. 12 may have more than two different lengths and cause more than two different sets of radial exit holes 130*c* in the flow piston to align with radial exit holes 120*c* in the housing. In this configuration, the amount of fluid flow that can be bypassed will vary with each setting resulting in a motor having more than two selectable speeds.

Figure 13A:
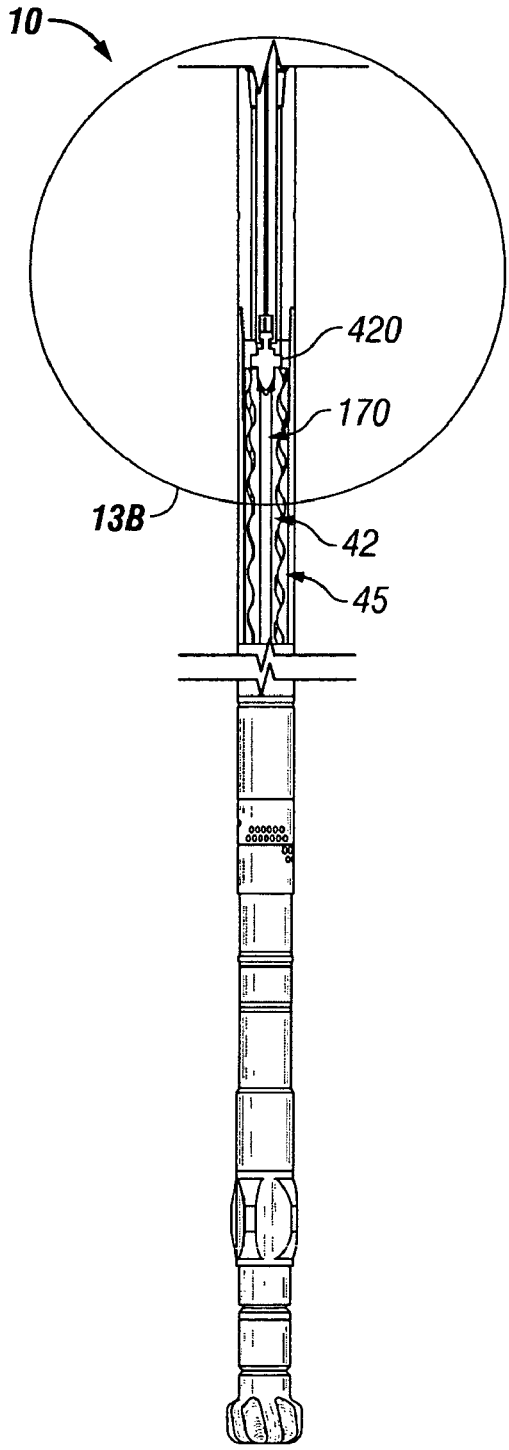
FIG. 13A is a view of an exemplary embodiment of a removable flow plug inserted into an exemplary embodiment of a positive displacement motor.
Figure 13B:
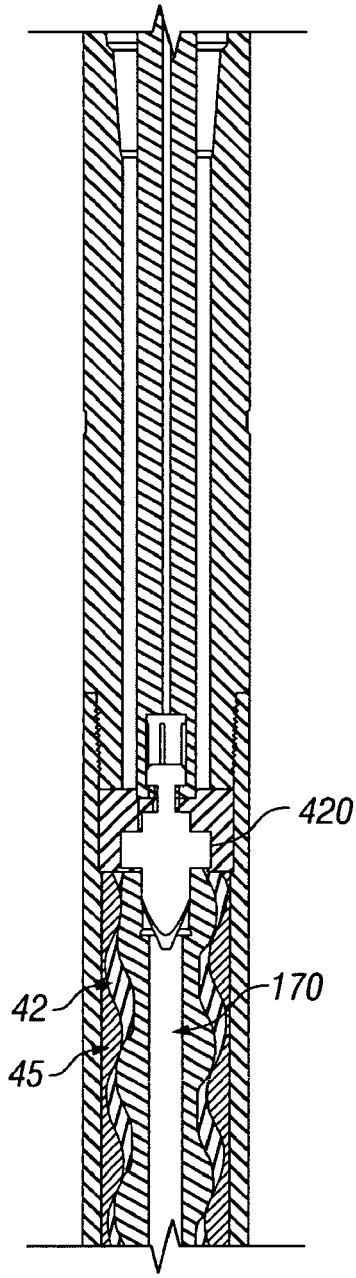
FIG. 13B is an enlarged view of a portion of the exemplary embodiment of the removable flow plug of FIG. 13A.

FIG. 13 shows a typical positive displacement motor 10 having a bypass valve (not shown) consistent with the invention herein and having a removable flow plug 420 for plugging the bypass valve. In this embodiment, the flow plug 420 is pre-installed at the surface and removed by a wireline tool by shearing the plug 420 from the valve. The plug 420 prevents fluid from entering the bypass channel 170 and thereby changing the speed of the motor when the bypass valve is open. If the bypass valve is of the type that opens and closes by cycling the mud pumps, the removable flow plug 420 prevents fluid flow pressure from entering the bypass channel 170 and activating the cam. The mud pump may be cycled any number of times without opening and closing the bypass valve. Other types of removable plugs for plugging an annulus in a downhole tool are well known in the art and can be used for this type of application.

It will be apparent to one of skill in the art that described herein is a novel method and apparatus for adjusting the speed of a mud motor down hole without the need to pull the motor out of the hole. While the invention has been described with references to specific preferred and exemplary embodiments, it is not limited to these embodiments. The invention may be modified or varied in many ways and such modifications and variations as would be obvious to one of skill in the art are within the scope and spirit of the invention and are included within on the scope of the following claims.

We claim:

1. An apparatus for controlling fluid flow through a power section of a tool comprising:

a valve having a cam mechanism the cam mechanism comprising an index ring;

a first flow control path in communication with the valve for conducting a fluid through the power section of the tool; and a second flow control path in communication with the valve for diverting the fluid around the power section of the tool, the fluid flow through the first and second flow control paths remaining entirely inside the tool;

wherein the valve controls the amount of fluid flow through at least one of the flow control paths using the cam mechanism.

2. The apparatus of claim 1 where the valve is actuated hydraulically.

3. The apparatus of claim 1 where the valve is actuated by cycling the fluid flow down a drill string.

4. The apparatus of claim 3 where the cam mechanism is spring-biased.

5. The apparatus of claim 1 where the valve opens in response to a change in pressure experienced by the motor.

6. The apparatus of claim 1 where the valve is actuated by a wireline running tool.

7. The apparatus of claim 1 where the valve is configured to cycle at least once through an open and a closed position.

8. The apparatus of claim 1 where the valve is configured to cycle a plurality of times between open and closed positions.

9. The apparatus of claim 1 where the valve comprises a plurality of open positions and at least one closed position and where each open position controls a rate of flow through at least one of the flow control paths.

10. The apparatus of claim 1 where the valve controls an operating characteristic of the tool.

11. The apparatus of claim 10 where the operating characteristic is speed, revolutions per minute, torque, flow rate, or pressure.

12. The apparatus of claim 1 where the fluid flow through one of the flow control paths comprises a gas.

13. The apparatus of claim 1 where the power section is a turbine.

14. The apparatus of claim 1 where the power section is a positive displacement motor.

15. The apparatus of claim 14 where the positive displacement motor comprises a rotor and stator.

16. The apparatus of claim 1 where the valve is actuated electrically.

17. The apparatus of claim 1 where the valve is actuated automatically.

18. The apparatus of claim 1 where the valve is actuated mechanically.

19. The apparatus of claim 1 further comprising a second valve in communication with the first and second flow control paths wherein the second valve controls the amount of fluid flow through at least one of the flow control paths.

20. The apparatus of claim 1 further comprising a second valve in communication with a third and a fourth flow control path, wherein the third flow control path conducts the fluid through the power section of the tool and the fourth flow control path diverts the fluid around the power section of the tool, and wherein the second valve controls the amount of fluid flow through at least one of the third and fourth flow control paths.

21. A method of changing operating characteristics of a downhole tool comprising the steps of:

pumping a fluid down a drill string through a power section of the downhole tool; and diverting a portion of the fluid around the power section of the tool using a bypass valve containing a cam mechanism, the step of diverting occurring without expelling fluid outside the drill string, wherein the cam mechanism indexes to effect changes in the operating characteristics of the downhole tool.

22. The method of claim 21 where the step of diverting fluid is accomplished by opening the bypass valve.

23. The method of claim 22 where opening the valve is accomplished automatically, manually, electrically, mechanically, or by a wireline running tool.

24. The method of claim 21 further comprising the step of cycling the bypass valve at least once through an open and a closed position.

25. The method of claim 21 further comprising the step of cycling the bypass valve through a plurality of open positions, wherein each open position controls an operating characteristic of the power section.

26. The method of claim 21 where the downhole tool is a mud motor.

27. The method of claim 21 further comprising the step of plugging the bypass valve.

28. The method of claim 21 further comprising the step of unplugging the bypass valve.

29. The method of claim 21 wherein the fluid comprises a gas.

30. The method as defined in claim 21, wherein the cam mechanism is configured to rotate axially along a flow path of the fluid each time a mud pump controlling the fluid flow is cycled on and off.

31. An apparatus comprising:

a motor having a power section capable of imparting rotational motion to a drill bit;

a bypass valve using a cam mechanism for diverting a fluid flow around the power section to change an operating characteristic of the motor, the cam mechanism being adapted to index about an axis of the fluid flow; and a flow control path for maintaining the diverted fluid flow inside a drill string.

32. The apparatus of claim 31 where the power section comprises a rotor and a stator.

33. The apparatus of claim 31 where the bypass valve is actuated automatically.

34. The apparatus of claim 31 further comprising at least one outlet valve that opens in response to a change in pressure experienced by the motor.

35. The apparatus of claim 31 where the bypass valve is actuated mechanically.

36. The apparatus of claim 31 where the bypass valve is actuated by a change in pressure.

37. The apparatus of claim 31 where the bypass valve is actuated by a change in fluid flow.

38. The apparatus of claim 31 where the operating characteristic is speed, revolutions per minute, torque, flow rate, or pressure.

39. The apparatus of claim 31 where the power section is a turbine.

40. The apparatus of claim 31 where the motor is a positive displacement motor.

41. The apparatus of claim 40 where the positive displacement motor comprises a rotor and stator.

42. The apparatus of claim 31 having a removable flow plug for plugging a channel used to divert the fluid around the power section of the tool.

43. The apparatus of claim 42 where the removable flow plug prevents fluid from entering the bypass valve.

44. The method as defined in claim 30, wherein the cam mechanism is configured such that each axial rotation of the cam mechanism alternates the bypass valve between an open or closed position.

45. The method as defined in claim 30, wherein the cam mechanism is configured such that each axial rotation results in varying amounts of fluid being allowed to flow through the bypass valve, thereby resulting in a motor having a plurality of selectable speeds.

46. An apparatus for controlling fluid flow through a power section of a tool comprising:

a valve including a spring-biased cam having an index ring;

a first flow control path in communication with the valve for conducting a fluid through the power section of the tool; and a second flow control path in communication with the valve for diverting the fluid around the power section of the tool while maintaining the diverted fluid inside the tool, wherein the valve controls the amount of fluid flow through at least one of the flow control paths.

47. An apparatus for controlling fluid flow through a power section of a tool comprising:

a first valve;

a first flow control path in communication with the valve for conducting a fluid through the power section of the tool;

a second flow control path in communication with the valve for diverting the fluid around the power section of the tool, wherein the valve controls the amount of fluid flow through at least one of the flow control paths; and a second valve in communication with the first and second flow control paths wherein the second valve controls the amount of fluid flow through at least one of the flow control paths.

48. An apparatus for controlling fluid flow through a power section of a tool comprising:

a first valve;

a first flow control path in communication with the valve for conducting a fluid through the power section of the tool;

a second flow control path in communication with the valve for diverting the fluid around the power section of the tool, wherein the valve controls the amount of fluid flow through at least one of the flow control paths; and a second valve in communication with a third and a fourth flow control path, wherein the third flow control path conducts the fluid through the power section of the tool and the fourth flow control path diverts the fluid around the power section of the tool, and wherein the second valve controls the amount of fluid flow through at least one of the third and fourth flow control paths.

* * * * *

UNITED STATES PATENT AND TRADEMARK OFFICE

CERTIFICATE OF CORRECTION

PATENT NO. : 7,523,792 B2
APPLICATION NO. : 11/292892
DATED : April 28, 2009
INVENTOR(S) : El-Rayes et al.

It is certified that error appears in the above-identified patent and that said Letters Patent is hereby corrected as shown below:

ON THE TITLE PAGE:

Item (73) Assignee:

Please change "National-Oilwell, Inc." to --National-Oilwell DHT, L.P.--

Signed and Sealed this

Thirtieth Day of March, 2010

David J. Kappos

David J. Kappos
*Director of the United States Patent and Trademark Office*